US005862927A

United States Patent [19]

Tebeau

[11] Patent Number: 5,862,927

[45] Date of Patent: Jan. 26, 1999

[54] BABY BOTTLE WITH STRAP

[76] Inventor: Jason Tebeau, 737 Judith Ct., Petaluma, Calif. 94952

[21] Appl. No.: 758,086

[22] Filed: Nov. 19, 1996

Related U.S. Application Data

[63] Continuation-in-part of Ser. No. 572,760, Dec. 14, 1995, Pat. No. 5,749,483.

[51] Int. Cl.[6] ..... A61J 9/06

[52] U.S. Cl. ..... 215/11.1; 215/399; 224/148.6; 224/219; 224/924; 248/104

[58] Field of Search ..... 215/11.1, 395, 215/399; 248/103, 104, 205.2, 102, 230.8; 224/250, 148.5, 158.6, 924, 219–221

[56] References Cited

U.S. PATENT DOCUMENTS

| | | | |
|---|---|---|---|
| 2,907,539 | 10/1959 | Vardan | 224/148.6 |
| 3,543,976 | 12/1970 | Ronald | 224/148.6 |
| 3,977,638 | 8/1976 | Woodard | 248/102 |
| 4,062,510 | 12/1977 | Brochu | 248/104 |
| 4,096,977 | 6/1978 | Barville et al. | 248/102 |
| 4,564,957 | 1/1986 | Scharf | 224/148.6 |
| 4,865,239 | 9/1989 | Timbrook | 224/200 |
| 4,915,337 | 4/1990 | Iwasaki | 248/311.2 |
| 4,946,119 | 8/1990 | Hellhake | 248/102 |
| 4,989,811 | 2/1991 | Millis et al. | 248/205.2 |
| 5,249,770 | 10/1993 | Louthan | 248/230.8 |
| 5,256,834 | 10/1993 | Daniels | 248/104 |
| 5,490,618 | 2/1996 | Davidson | 224/222 |

FOREIGN PATENT DOCUMENTS

| | | | |
|---|---|---|---|
| 2067416 | 7/1981 | United Kingdom | 215/11.4 |

*Primary Examiner*—Stephen P. Garbe
*Attorney, Agent, or Firm*—Robert O. Guillot

[57] ABSTRACT

The improved baby bottle device includes a liquid holding container having a flexible liquid flow tube engaged thereto. A nipple is engaged to the distal end of the liquid flow tube, and a liquid flow control device is disposed within an adaptor that serves to engage the nipple with the liquid flow tube to control the flow of liquid from the bottle to the nipple, such that liquid neither leaks from the nipple when the nipple is disposed below the container nor drains from the nipple when the nipple is disposed above the container. In the preferred embodiment, the liquid flow control device includes a spring loaded check valve. A bottle attachment device, generally including two velcro straps joined at their midpoints is used to attach the bottle device to adjacent structural support members.

14 Claims, 2 Drawing Sheets

BABY BOTTLE WITH STRAP

REFERENCE TO RELATED APPLICATIONS

This application is a continuation in part of U.S. patent application Ser. No. 08/572,760, entitled Improved Baby Bottle, filed Dec. 14, 1995, now U.S. Pat. No. 5,749,483.

BACKGROUND OF THE INVENTION

1. Field of the Invention

The present invention relates generally to baby feeding bottles, and more specifically to bottles having liquid flow path including a flexible tube extending from the bottle to the nipple, and wherein a liquid flow control valve is disposed within the liquid flow path, and where an attachment strap is provided for engaging the bottle to a support member.

2. Description of the Prior Art

Baby feeding bottles are generally well known, and bottle devices having a flexible liquid flow tube engaged between a nipple and a liquid holding container are likewise known, as is disclosed in U.S. Pat. No. 4,898,290, issued Feb. 6, 1990 to Cueto. A bottle device such as taught by Cueto allows a nipple to be disposed within an infant's mouth where the infant or its caregiver does not have to hold the bottle in an inverted position for liquid to flow. Rather, as taught by Cueto, the bottle can be placed adjacent to the infant and the tube permits the flow of liquid from the bottle to the nipple disposed in the infant's mouth.

A drawback of the Cueto type bottle device is that fluid in the extended feeding tube will drain away from the nipple and back into the bottle when the nipple is sufficiently elevated above the bottle. This condition can lead to the infant sucking and ingesting air in a vain attempt to obtain liquid through the nipple. Conversely, fluid will leak from the nipple continuously where the nipple is sufficiently lowered below the elevation of the bottle. This condition can lead to the draining of the bottle contents into the bedding of the infant. Thus, either condition creates a less than optimum performance of the device. The present invention solves both of these problems through the utilization of a liquid flow control valve in the liquid flow path which prevents both liquid back flow and liquid drainage.

The attachment strap mechanism of the present invention facilities the near vertical holding of the bottle, and does not appear to have a counterpart in the prior art.

SUMMARY OF THE INVENTION

It is an object of the present invention to provide an improved baby bottle device that has a liquid flow tube between the nipple and the liquid container and which includes a liquid flow control device.

It is another object of the present invention to provide an improved baby bottle device wherein a remotely disposed nipple in fluid communication with a liquid containing bottle will not leak when the nipple is disposed in a lowered location relative to the bottle.

It is a further object of the present invention to provide a remotely disposed nipple in fluid communication with a liquid container, wherein liquid will not drain from the nipple when the nipple is disposed in an elevated location relative to the liquid container.

It is yet another object of the present invention to provide an attachment strap mechanism which permits the user to easily attach the bottle to a variety of structural members, such that the bottle is orientated in a near vertical position.

The improved baby bottle device of the present invention includes a liquid holding container having a flexible liquid flow tube engaged thereto. A baby nipple is engaged to the distal end of the liquid flow tube. A liquid flow control device is disposed within an adaptor that serves to engage the nipple with the liquid flow tube to control the flow of liquid from the bottle to the nipple, such that liquid neither leaks from the nipple when the nipple is disposed below the container nor drains from the nipple when the nipple is disposed above the container. In the preferred embodiment, the liquid flow control device includes a spring loaded check valve. A valve cracking pressure of approximately 0.94 pounds per square inch has been determined to be appropriate for controlling fluid movement through the tube, yet permit relatively unimpeded fluid access to the sucking infant. The attachment strap mechanism is preferably formed from two velcro straps that are joined at their center points utilizing a rivet or similar connection which permits the relative rotation of the straps. The attachment strap mechanism allows the user to engage the bottle in a near vertical orientation to structural members that have virtually any orientation.

It is an advantage of the present invention that it provides an improved baby bottle device that has a liquid flow tube between the nipple and the liquid container and which includes a liquid flow control device.

It is another advantage of the present invention that it provides an improved baby bottle device wherein a remotely disposed nipple in fluid communication with a liquid containing bottle will not leak when the nipple is disposed in a lowered elevation relative to the bottle.

It is a further advantage of the present invention that it provides a remotely disposed nipple in fluid communication with a liquid container, wherein liquid will not drain from the nipple when the nipple is disposed in an elevated location relative to the liquid container.

It is yet another advantage of the present invention that it provides a strap attachment mechanism that allows the user to attach the bottle in a near vertical orientation to other structural members.

These and other objects, features and advantages of the present invention will become well understood upon reading the following detailed description of the invention.

IN THE DRAWINGS

DETAILED DESCRIPTION OF THE PREFERRED EMBODIMENTS

Figure 1:
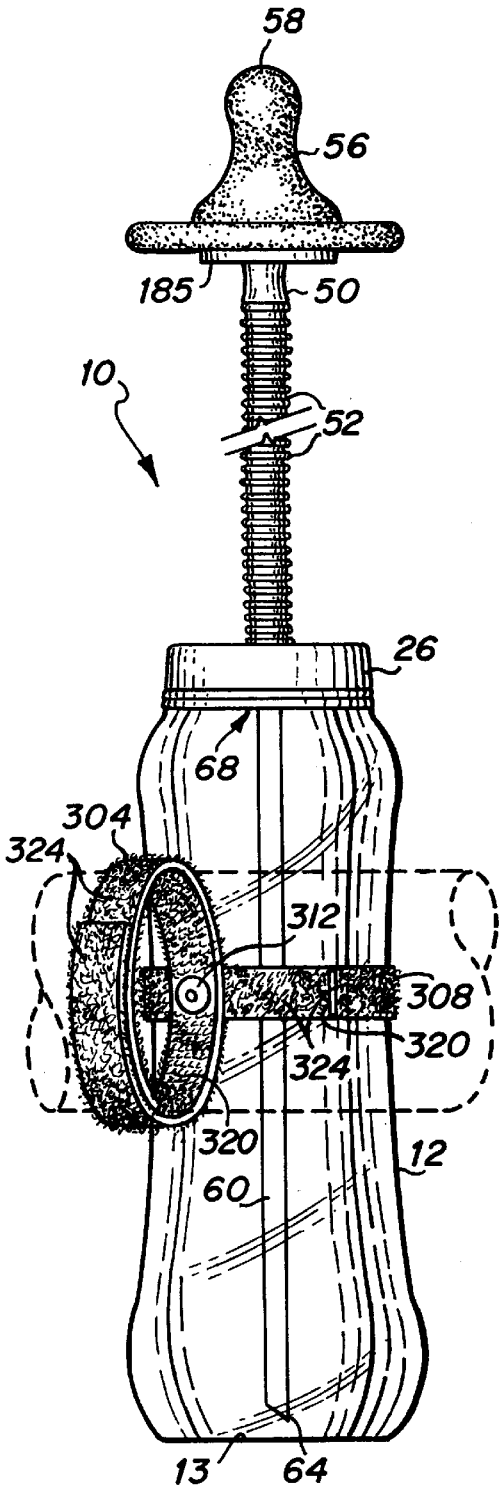
FIG. 1 is a side elevational view of the improved baby bottle of the present invention.
Figure 2:
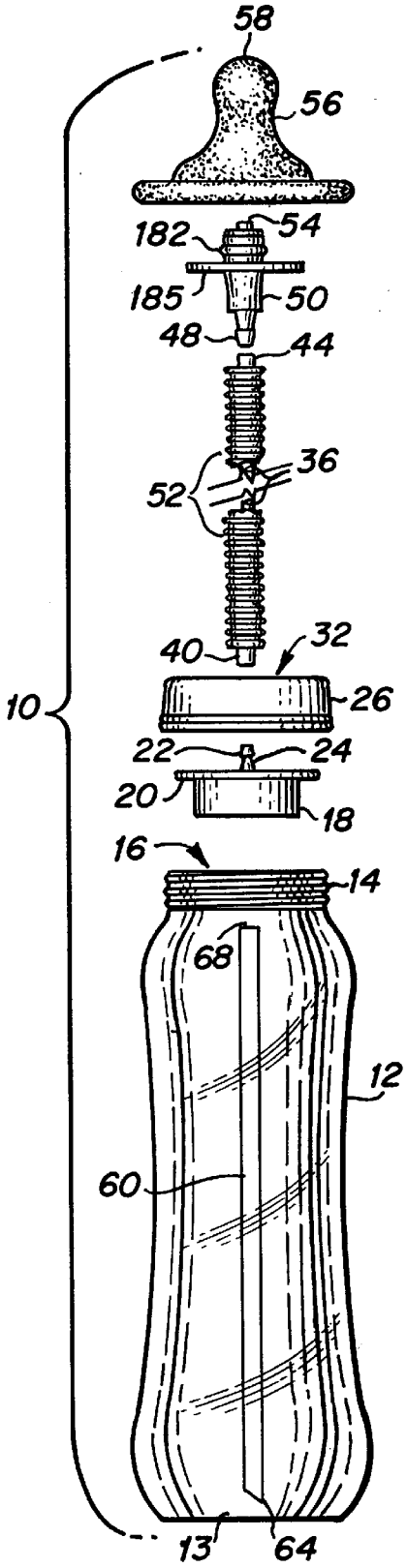
FIG. 2 is an exploded side elevational view of the improved baby bottle depicted in FIG. 1.

The improved baby bottle of the present invention is best understood with a joint consideration of FIGS. 1 and 2, wherein FIG. 1 is a side elevational view and FIG. 2 is an exploded side elevational view. As depicted in FIGS. 1 and 2, the present invention 10 includes a standard liquid holding baby bottle 12 having a lower base 13 and a threaded neck 14 which defines an upper opening 16. A bottle closure disk 18 is formed with an outwardly projecting edge portion 20 that sealingly engages the outer edge of the opening 16 of the bottle 12. The disk 18 includes a centrally disposed upwardly projecting upper tube engagement member 22 having a barbed end 24. A bottle cap 26 having internal threads (not shown) is threadably engagable with the threads 14 of the bottle 12. The cap 26 is formed with a centrally disposed opening 32 therethrough, such that the upper tube engagement member 22 projects therethrough.

A flexible liquid flow tube 36 is engaged at its lower end 40 to the upper tube engagement member 22. The upper end 44 of the tube 36 is engaged to a tube engagement member 48 of a nipple valve adaptor 50. A corrugated outer tube 52 surrounds the liquid flow tube 36 to give it strength and to prevent kinking of the tube 36. The adaptor 50 includes a check valve device 54 disposed therewithin, and the adaptor 50 is shaped to be removably engagable within a nipple 56. The nipple 56 has a feeding hole 58 (best seen in FIG. 4) formed therethrough and is formed from a standard, flexible PVC material for compression by an infant during feeding. A liquid removal tube 60 is disposed within the bottle 12 such that a lower liquid intake end 64 of the tube 60 is disposed towards the bottom 13 of the bottle 12. The upper end 68 of the tube 60 is engaged with a lower tube engagement projection 72 formed within the disk 18, as is best shown in FIG. 3.

Figure 3:
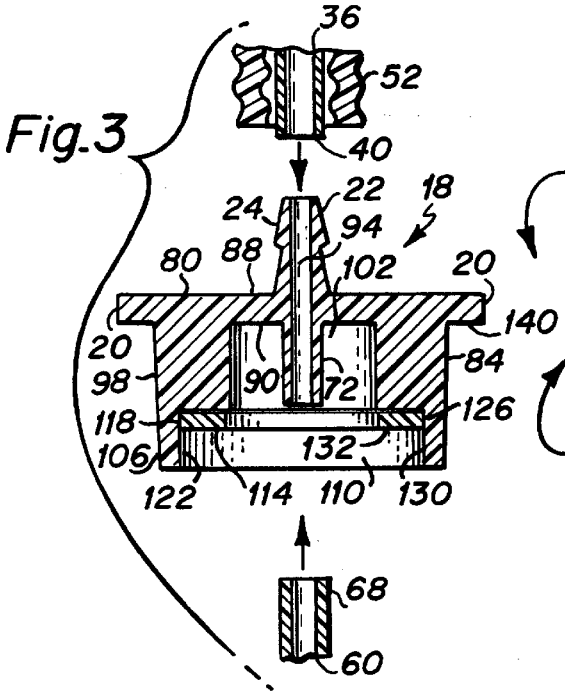
FIG. 3 is a side cross-sectional view of the disk 18 of the present invention.

FIG. 3 is a side cross-sectional view of the disk 18 of the present invention. As depicted in FIG. 3, the disk 18 includes a flat disk portion 80 and a downwardly depending circumferential wall portion 84 that are integrally molded. The upper tube engagement projection 22 is integrally formed with the disk 80 and projects upwardly from an upper surface 88 of the disk 80. The lower tube engagement projection 72 is integrally formed with the disk 80 and projects downwardly from a lower surface 90 of the disk 80. A fluid passage channel 94 is formed through the lower tube engagement member 72 and through the upper tube engagement member 22, such that fluid from the bottle 12 passes through the tube 60, through the channel 94 and into the tube 36 when the bottle components are assembled.

The walls 84 of the disk 18 are thickened in an upper portion 98 to create an upper cylindrical chamber 102. The walls 84 have a thinner lower portion 106 which define a lower cylindrical chamber 110 having a larger diameter than the upper chamber. In the preferred embodiment, a rubber cleanout washer 114 is disposed in the lower chamber 110 such that the outer edges 118 of the washer 114 frictionally engage the inner wall surfaces 122 of the lower wall portions 106. In the preferred embodiment, the wall surfaces 122 are tapered inwardly such that the upper edge 126 of the wall surface 122 has a smaller diameter than the outer edge 130 of the wall surface 122. The inward taper serves to frictionally hold the washer 114 in place within the disk 18, and a taper of 0.001 inches has proved sufficient where the diameter of the washer 114 is approximately equal to the diameter at the outer edge 130 of the wall surface 122 of the chamber 110.

It is to be understood that the cleanout washer 114 serves no function when the bottle is being used. Rather, it is utilized when the disk 18, tube 36, adaptor 50 and check valve 54 are being cleaned. Specifically, the diameter 130 of the lower chamber 110 is designed to be somewhat larger than the outer diameter of a standard kitchen faucet. When the disk 18 with attached flow tube 36 and adaptor 50 components (discussed below) are to be cleaned, the disk 18 is inverted from its orientation shown in FIGS. 1, 2 and 3 and pressed by hand onto the faucet opening such that the lower edge of the faucet makes a watertight seal with the outer surface 132 of the washer 114. Then, warm water is run from the faucet into the disk 18, and specifically through the channel 94, flow tube 36 and adaptor components at a high velocity to clean the channel 94, the flow tube 36 and the adaptor 50 components. Thereafter, the washer 114 is removed by hand and the washer and the remaining portions of the disk 18 are cleaned. The washer is then reinserted into its position within the disk 18 for later usage in cleaning the device 10 after it has been used again.

The disk 18 is formed with an air intake channel 140 that is formed as a radially extending groove cut into the lower surface 90 of the disk portion 88 at an outer edge 20 thereof. It is to be understood that when the disk 18 is firmly engaged to a bottle 12 by the threaded engagement of the cap 26 to the threaded neck 14 of the bottle, that the removal of liquid from the bottle requires air to be replaced into the bottle; the air intake channel 140 serves this purpose.

Figure 4:
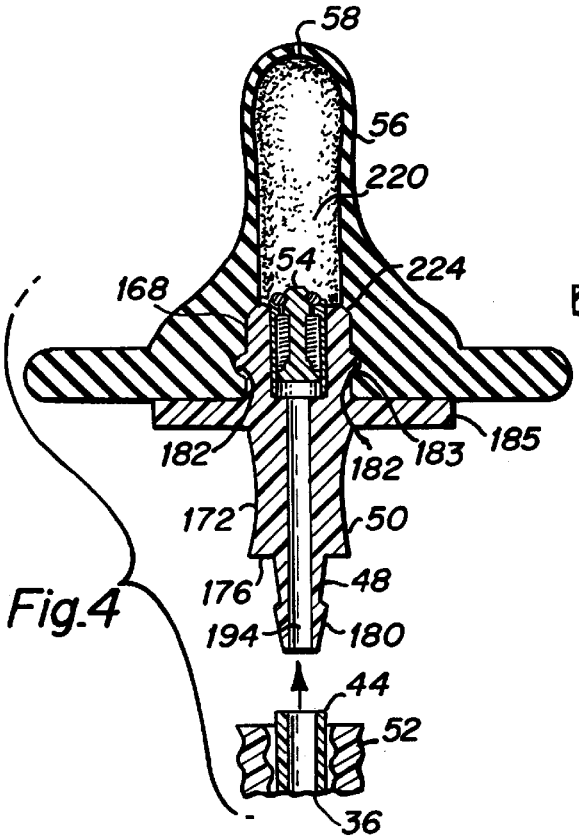
FIG. 4 is a cross-sectional view of the adaptor 50 shown in engagement with the nipple 56 of the present invention.
Figure 5:
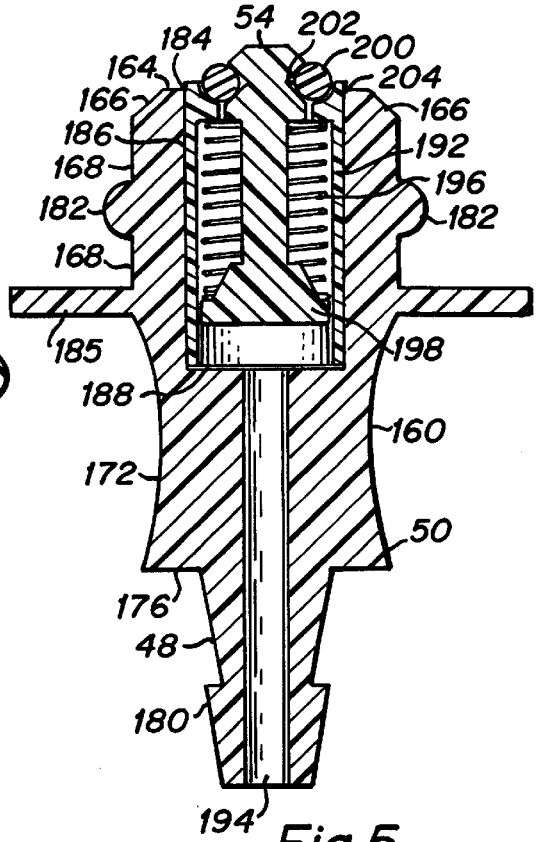
FIG. 5 is an enlarged cross-sectional view of the adaptor and check valve.

FIG. 4 is a cross-sectional view of the adaptor 50 in engagement with the nipple 56 of the present invention, and FIG. 5 is an enlarged view showing the check valve 54 within the adaptor 50. As depicted in FIGS. 4 and 5, the adaptor 50 includes a molded body 160 having a top surface 164, a sloped shoulder 166, upper sidewall portions 168, lower sidewall portions 172, a lower surface 176 and a downwardly tapering tube engagement member portion 48 having a projecting barbed end portion 180 formed for the engagement with the upper end 44 of the flexible tube 36. An outwardly projecting nipple engagement ridge 182 is formed in the upper sidewall portion 168 of the adaptor 50 to matingly engage a circumferential groove 183 formed in the inner surface of the nipple 56. The groove 183 and ridge 182 serve to hold the nipple in frictional engagement with the adaptor 50. An outwardly projecting nipple stop ring 185 is formed in the upper sidewall portions 168 of the adaptor 50 to provide a stopping surface against the insertion of the adaptor 50 into the nipple 56.

A cylindrical cavity 184 is formed in the adaptor 50 downwardly through the upper surface 164. The cavity 184 is defined by internal sidewalls 186 and a lower internal surface 188. A check valve mechanism 54 having cylindrical sidewalls 192 is disposed within the cylindrical cavity 184 such that its sidewalls 192 are frictionally engaged within the sidewall 186 of the cavity 184. A fluid passage channel 194 is centrally formed through the adaptor 50 from the tube engagement portion 48 upwardly to the lower surface 188 of the cavity 184, such that fluid may pass through the channel 194 and into the cavity 184. Sidewalls 192 of the check valve 190 are formed to make a fluid tight seal with the sidewalls 186 of the cavity 184, such that the fluid passing through the channel 194 passes into the check valve 54. In the preferred embodiment, the check valve 54 includes a check valve spring 196 which presses against a centrally disposed valve member 198, and an O-ring 200 is disposed in a groove 202 formed in an upper end of the valve member 198 to provide a fluid seal against a ring-like opening 204 in the upper end of check valve 54.

In the preferred embodiment, the check valve 54 has a cracking pressure of approximately 0.94 pounds per square inch. The cracking pressure of the valve is chosen such that a baby can easily create sufficient sucking force to pull the valve element 198 forward against the spring, such that fluid will easily flow through opening 204 and thus through the adaptor upon sucking by an infant on the nipple 56.

However, the spring force must be strong enough such that fluid will not leak through the adaptor when the adaptor is in a downward position relative to the location of the bottle. In the preferred embodiment, the length of the flexible tube 36 is approximately 12 inches, and it has been determined that the cracking pressure of approximately 0.94 pounds per square inch is sufficient to withstand the fluid head created when the adaptor 50 is disposed 12 inches below the bottle 12. A generally cylindrical liquid dispensing cavity 220, having a sloped shoulder 224, is formed in the nipple 56 to matingly engage the adaptor 50 therewithin. The generally cylindrical shape of the cavity 220 inhibits liquid retention within the nipple 56 and facilitates cleaning of the nipple 56.

Figure 6:
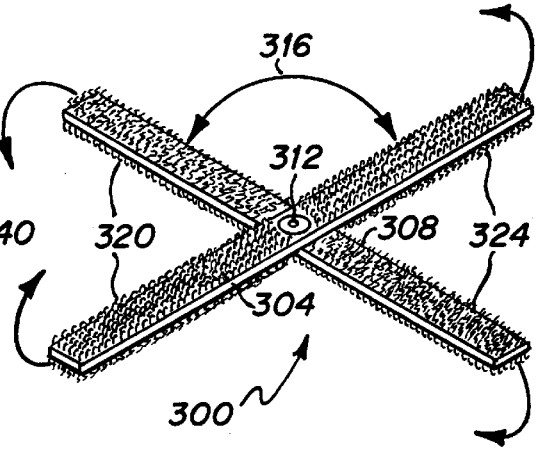
FIG. 6 is a plan view depicting the attachment strap mechanism of the present invention.

The attachment strap mechanism of the present invention is depicted in FIGS. 1 and 6, wherein FIG. 1 is a perspective view thereof and FIG. 6 is a top plan view thereof. As depicted in FIGS. 1 and 6, the attachment strap mechanism 300 of the present invention includes two attachment straps 304 and 308 that are rotatably joined together at their mid-points utilizing an attachment means such as a rivet 312. The rivet 312 is impacted loosely enough to allow the two straps 304 and 308 to rotate 316 relative to each other. In the preferred embodiment, each strap 304 and 308 includes a hook and loop attachment mechanism having the trade name "VELCRO" wherein hook members 320 are disposed on one side of each strap and loop members 324 are disposed on the opposite side of each strap 304 and 308 respectively. The straps 304 and 308 are preferably joined together such that the loop side 324 of each strap faces the other, whereby the loop sides 324 of each strap are disposed in frictional contact. In this configuration, the hooks and loops at the ends of each strap will become engaged when the strap is wrapped around an object, as depicted in FIG. 1 and next described.

The attachment strap mechanism 300 of the present invention is utilized to engage the bottle 12 to a structural member such as tubular member 340, shown in phantom in FIG. 1. Specifically, strap 308 is tightly wrapped around the bottle 312, whereas strap 304 is tightly wrapped around structural member 340, such that the respective hook and loop sides of each strap are engaged. The rivet 312 permits the straps 304 and 308 to rotate relative to one another, such that strap 304 is engaged to the generally horizontal structural member 340, whereas strap 308 permits the bottle 12 to be oriented vertically, such that the lower end 64 of the tube 60 will be able to reach liquid disposed in the bottom of the bottle 12. The loop side to loop side engagement of the two straps 304 and 308 facilitates the rotational movement of each strap relative to the other strap. In the preferred embodiment, the bottle 12 is formed with a relatively narrow waist portion 344, such that the bottle 12 will not slip out of the strap 308, as might occur if the sides of the bottle were straight.

It is to be understood that while FIG. 1 depicts the attachment of the bottle 12 to a horizontal structural member 340, the rotatable nature of the straps relative to each other, as facilitated by the rivet 312, will allow the bottle 12 to be engaged in an approximately vertical orientation to structural members that are disposed in virtually any orientation; that is, vertically, angularly or horizontally (as shown in FIG. 1).

While the present invention has been described with reference to certain preferred embodiments, various alterations and modifications in form and detail will no doubt occur to those skilled in the art that have read and understood this disclosure. It is therefore intended that the following claims cover all such alterations and modifications as fall within the true spirit and scope of the invention.

What I claim is:

1. A baby bottle device comprising:

a container for holding a liquid therewithin;

a nipple for liquid removal from said container;

an extended liquid flow tube means having a first end in fluid communication with said bottle and a second end in fluid communication with said nipple;

a liquid flow control means being disposed in fluid communication with said liquid flow tube means to control the flow of liquid from said bottle to said nipple;

a container attachment means including a first strap member that is engagable to said container, a second strap member and a strap engagement means functioning to hold said first strap member and said second strap member together; and wherein said strap engagement means further functions to provide a rotatable engagement of said first and second strap members relative to each other.

2. A device as described in claim 1 wherein said container is formed with concave sidewall portions to cooperatively engage said first strap member.

3. A device as described in claim 2 wherein said first strap member includes a first strap end engagement means functioning to engage a first end and a second end of said first strap member together.

4. A device as described in claim 3 wherein said second strap member includes a second strap end engagement means functioning to engage a first end and a second end of said second strap member together.

5. A device as described in claim 4 wherein said first strap end engagement means and said second strap end engagement means includes a hook and loop engagement means.

6. A device as described in claim 5 wherein the loop portion of said hook and loop engagement means of said first strap member is disposed on one side of said first strap member and said loop portion of said hook and loop engagement means of said second strap member is disposed on one side of said second strap member; and wherein the loop side of said first strap member is disposed in frictional contact with the loop side of said second strap member.

7. A device as described in claim 1 wherein said strap engagement means includes a rivet that is disposed proximate the mid-point of each strap member.

8. A baby bottle attachment device comprising:

a first strap member;

a second strap member; and a strap engagement means functioning to hold said first strap member and said second strap member together in a rotatable engagement relative to each other; wherein said first strap member includes a strap and engagement means functioning to engage a first end and a second end of said first strap member together; and wherein said second strap member includes a strap end engagement means functioning to engage a first end and a second end of said second strap member together.

9. A device as described in claim 8 wherein said strap engagement means includes a rivet that is disposed proximate the mid-point of each strap member.

10. A baby bottle device comprising:

a container for holding a liquid therewithin;

a nipple for liquid removal from said container;

an extended liquid flow tube means having a first end in fluid communication with said bottle and a second end in fluid communication with said nipple;

a liquid flow control means being disposed in fluid communication with said liquid flow tube means to control the flow of liquid from said bottle to said nipple;

a container attachment means including a first strap member that is engagable to said container, a second strap member and a strap engagement means functioning to hold said first strap member and said second strap member together;

wherein said first strap member includes a hook and loop strap end engagement means functioning to engage a first end and a second end of said first strap member together, and wherein said second strap member also includes a hook and loop strap end engagement means functioning to engage a first end and a second end of said second strap member together, and wherein the loop portion of said hook and loop engagement means of said first strap member is disposed on one side of said first strap member and said loop portion of said hook and loop engagement means of said second strap member is disposed on one side of said second strap member; and wherein said loop side of said first strap member is disposed in frictional contact with said loop side of said second strap member.

11. A device as described in claim 10 wherein said strap engagement means further functions to provide a rotatable engagement of said first and second strap members relative to each other.

12. A device as described in claim 11 wherein said strap engagement means includes a rivet that is disposed proximate the mid-point of each strap member.

13. A device as described in claim 8 wherein said first strap member includes a hook and loop engagement means, and wherein said second strap member includes a hook and loop engagement means, and wherein the loop portion of said hook and loop engagement means of said first strap member is disposed on one side of said first strap member and said loop portion of said hook and loop engagement means of said second strap members is disposed on one side of said second strap member, and wherein the loop side of said first strap member is disposed in frictional contact with the loop side of said second strap member.

14. A device as described in claim 8 wherein said strap engagement means includes a rivet that is disposed proximate the mid-point of each strap member.

* * * * *